US005283964A

United States Patent [19]

Chemello

[11] Patent Number: 5,283,964

[45] Date of Patent: Feb. 8, 1994

[54] SKI BOOT WITH UPPER LOCKING DEVICE

[75] Inventor: Jean-Pierre Chemello, Annecy-le-Vieux, France

[73] Assignee: Salomon S.A., Chavenod, France

[21] Appl. No.: 907,019

[22] Filed: Jul. 1, 1992

[30] Foreign Application Priority Data

Jul. 1, 1991 [FR] France ..... 91 08504

[51] Int. Cl.[5] ..... A43B 5/04

[52] U.S. Cl. ..... 36/117; 36/120; 36/121

[58] Field of Search ..... 36/117, 118, 119, 120, 36/121

[56] References Cited

U.S. PATENT DOCUMENTS

| | | | |
|---|---|---|---|
| 4,499,676 | 2/1985 | Chalmers, II | 36/117 |
| 4,622,765 | 11/1986 | Baratto et al. | 36/120 |
| 4,928,406 | 5/1990 | Montfort | 36/117 |
| 5,031,341 | 7/1991 | Paris et al. | 36/120 |
| 5,065,533 | 11/1991 | Paris | 36/120 |
| 5,075,983 | 12/1991 | Mabboux et al. | 36/120 |
| 5,136,794 | 8/1992 | Stampacchia et al. | 36/120 |

FOREIGN PATENT DOCUMENTS

| | | |
|---|---|---|
| 0358599 | 3/1990 | European Pat. Off. . |
| 8020898 | 11/1980 | Fed. Rep. of Germany . |
| 2648327 | 12/1990 | France . |
| 6647649 | 12/1990 | France . |

*Primary Examiner*—Steven N. Pmeyers
*Assistant Examiner*—M. D. Patterson
*Attorney, Agent, or Firm*—Pollock, Vande Sande & Priddy

[57] ABSTRACT

The boot (1) comprises a device (35) for front-to-back immobilization of the upper (2), which acts on an oscillating lever (11) capable of being supported against a stop (13) on the shell base (5). The device is constituted by a rectilinear-motion control mechanism (10) incorporating an external control device (18), of which an inner part (19) actuates, via a cam (19*a*), a sensing device (49) associated with the oscillating lever (11) so as to impart to the latter an angular rotating movement around its pin (12) toward a locked or released position in relation to the stop (13) formed on the shell base (5).

9 Claims, 6 Drawing Sheets 16a
17'
17
20

20
18
10
49
19a
11b
11
19
35
16a
14
11a
13

4
2
16
8a
9a
7a
3
9b
7b
8b
1
7c
9c
8c
5
6
35
F1
17
20
10
19a
19
25
24
49
11b
25
18
19c
12
11
16a
14
15
11a
13

SKI BOOT WITH UPPER LOCKING DEVICE

FIELD OF THE INVENTION

The present invention relates to an alpine ski boot comprising a rigid shell, including a shell base surmounted by an upper at least partially jointed on this base, having at least one front part and one rear part and comprising, in turn, opening means allowing insertion of the foot and an assembly for enclosing the upper over the bottom of the leg comprising a tightening system incorporating at least one traction element at least partially surrounding the upper, to be placed under tensioning by at least one tension device, and fastened on at least one of the component parts of the upper.

More specifically, the invention relates to means for immobilizing the upper in a front-to-back direction, these means being constituted by a control mechanism acting on a lever pivotable around a transverse pin in a rear part of the upper between a first position in which a lower end section of the lever is stopped against a rear stop on the shell base in the heel area or a selected forward position of inclination of the upper corresponding to an operative skiing position, and a second position in which the lower part is released from the rear stop on the shell base in order to free the upper from any angular positioning stress, the control device then acting on another part of the oscillating lever, in opposition to an elastic device.

BACKGROUND OF THE INVENTION

Proposals have been made, in particular, for means for manual locking of the aforementioned bascule, which are capable of immobilizing the latter in a stable position corresponding to the release of the boot upper, as disclosed in FR-A 2 648 327. According to the latter, the manual locking means are constituted by a piece which is movable in vertical translational motion at the upper end of an arm of the bascule and which can be manually operated in an upward sliding movement, in order to extend this upper end of the bascule and to cooperate with a notch provided in the upper part of a recess in the upper, so as to hold the bascule in the released position. Downward slide control of this mobile piece frees the latter from the upper notch and allows it to pivot under the action of an elastic device, to ensure that the lower end of this bascule is stopped, on the aforementioned stop set on the rear part of the shell base, for an operative position.

To allow operation of the mobile piece in translational motion in either direction, this piece has a projecting part forming an outer gripping element, without which any control would be impossible.

These locking means have a number of disadvantages, since it is necessary to provide, first, a relatively thick bascule, since the latter supports the mobile part and the gripping element attached to it, and second, an upper notch to be cut in the upper.

Finally, as regards use, this system still involves two operations to produce a stable release of the boot upper, i.e., a substantially rectilinear thrusting movement perpendicular to the upper, in order to cause the bascule to pivot in a movement freeing its lower end from the stop, and a thrusting movement, also rectilinear and substantially parallel to the upper, so as to engage the mobile component beneath the upper notch.

This last disadvantage does not inhere in other conventional devices for immobilization of the upper of a boot, in which the means for locking, and indeed for control, of the bascule are independent from the latter. As an example, in the ski boot described in the French Patent Application FR 2 619 317, the upper-immobilization device comprises a stop means which is subjected to the continuous action generated by an elastic force which pushes it into its closed position, and can be maneuvered into an open position in opposition to this force, by means of a control device located in the upper.

As illustrated, the stop means is housed in a recess in the upper and is shaped like a dual-arm lever pivoting around a pin mounted in the upper, while the control device is mounted so as to pivot on the outside of the upper and in proximity to the end of one of the arms of the stop lever.

In this kind of construction, the upper is released by virtue of an outward swivelling movement of the control mechanism which, by exerting pressure on the corresponding arm of the stop lever, produces the release of this arm from its stop on the shell base. To relock the upper in the skiing position, it then becomes necessary to bring the control device back against the upper in order to permit the stop lever, subjected to the elastic return force, to be placed in the engaged position in relation to its stop on the shell base.

This immobilization device has the disadvantage of protruding in a very pronounced fashion on the rear part of the upper, and of requiring voluntary manipulation of the control mechanism in order to return to a locked position of the upper for the purpose of skiing.

As a further example, mention may be made of the device for immobilization of a ski boot upper described in German Utility Model GM of Utility Gm 80 20 898 which shows an immobilization device incorporating a lever attached to the upper and capable of being stopped on an element of the boot shell. The lever is controlled by an outer traveller that can be moved linearly and can affect angularly the position of the lever beginning at an end, or central, point of articulation.

As in the preceding case, this device has the disadvantage of protruding from the rear part of the upper in permanent and variable fashion, since the traveller can be moved in translational motion. Furthermore, it always requires a voluntary operation performed by the skier to move from the released position to the locked skiing position. In addition, the momentary-release maneuver, with the potential for automatic relocking, is not possible.

SUMMARY OF THE INVENTION

It is an object of the present invention to overcome these by means of immobilization of the upper of a ski boot which can:

immobilize the boot upper permanently and in stable fashion in relation to the shell base to permit skiing;

release this upper, also permanently and in a stable manner, to facilitate the use of the boot for walking; and rapidly release the upper simply to allow the boot to be removed or to enable the skier to adopt a standing relaxed position, accompanied, advantageously, by automatic relocking in the skiing position as soon as the control mechanism is disengaged and the upper is returned to its original angled skiing position.

According to the invention, the alpine ski boot comprises a shell base surmounted by an upper having a front and a rear parts composed of one or more pieces, the rear part of this upper, being capable of pivoting at least partially back-to-front and/or front-to-back, and comprising a device for immobilization in relation to the functional shell base for at least one of these pivoting directions, by means created.

One inventive feature is that the immobilization device can be operated using a device controlling an oscillating lever, this control device being constituted by a traveller movable in translational motion mounted so as slide on a slide-rail positioned in the rear part of the upper. This slide-rail is given material form by at least one of the longitudinal edges of an oblong opening in the rear part of the upper. The traveller comprises an outer gripping element whose sliding motion can be manually controlled, and an inner part which, by means of a cam, acts on a sensing device which secures the oscillating lever in its pivoting motion, the aforementioned outer and inner parts being connected by a bearing associated with at least one groove in which the slide-rail in the upper is housed.

Another inventive feature is that the cam extends parallel to the axis of translational motion of the traveller, whether it is attached to the end of the inner part of the traveller or to the oscillating lever. A sensing device designed to cooperate with the cam is thus provided on the component not fitted with this cam. Furthermore, the cam incorporates at least one ramp having a progressively-increasing slope extending from a low sensing point to a high point extended by a zone of position retention of the sensing device. The difference in height between the low and high sensing points is determined as a function of the engagement of the oscillating lever on the stop or catch zone formed on the shell base and is at least sufficient to cause, by means of the sensing device, the pivoting motion of the oscillating lever corresponding at least to the pivoting motion of its engagement on the shell base and to produce the release of the boot upper.

According to a first embodiment, the cam incorporates two symmetrical, progressively increasing ramps, each of which extends from the low point of the cam to a position-retention zone. The control mechanism of the immobilization device associated with the cam can also be maneuvered equally well in both directions of translational motion in order to produce the release of the boot upper from the shell base.

According to a second embodiment, the cam comprises, beginning at a low point and to one side, a progressively-increasing ramp such as that described above, and, on the other side, a vertical wall or stop surface, against which the sensing device abuts. In this kind of construction, the mechanism associated with the immobilization device can thus be actuated only in a direction of rotation corresponding to the direction in which the ramp extends.

According to a third embodiment, the cam incorporates two asymmetrical ramps which extend beginning at the low point and on either side of it. In this construction, one of the ramps is thus designed to permit permanent release, and the other, momentary release. To this end, the first ramp ends, at the high release point of the cam, in a zone of position retention of the sensing device, while the second ramp extends at least to the height of the high point of the first ramp, but without comprising an area of position retention of the sensing device. Accordingly, when the cam moves in translational motion along the second ramp, the upper-immobilization device can be released, and can be returned automatically to the original locked position as soon as the mechanism controlling the cam is disengaged. To facilitate this return to the locked position, the cam and/or the control device can be advantageously equipped with an elastic return element. In addition, with or without this elastic return element, the unstable cam-release ramp can be made with a relatively pronounced slope, so that, under the effect of the thrust of the return spring on the oscillating lever, the bearing stress exerted by the sensing device on this latter promotes its return to the original position on the low point, when the control mechanism is disengaged.

In these embodiments of a cam incorporating two asymmetrical ramps, only one of the directions of translation travel applied to the control mechanism thus determines either the momentary release of the immobilization device, accompanied by automatic return to the locked position when disengagement occurs, or permanent release when the sensing device is retained on the high point of the cam.

Still in conformity with the invention, the upper-immobilization device can be configured so as to immobilize the upper in the front-to-back pivoting direction only, or in both pivoting directions, i.e., front-to-back or back-to-front, in relation to the shell base. In the case of immobilization in the front-to-back direction alone, the oscillating lever comprises an end piece which cooperates, for example, with a stop zone formed on the shell base. When immobilization occurs in both directions of pivoting, the oscillating lever comprises a lug or catch piece which cooperates with a corresponding notch in the shell base, when the rear part of the upper is brought into the operative skiing position. In addition, when it becomes necessary to provide for a degree of freedom to pivot of the rear part of the upper and/or of the upper before immobilization, in particular to allow control of the amplitude of flection of the upper, for example forward flection, the slot extends vertically above the catch piece over a length determined by the thickness of this piece and the desired pivoting travel.

BRIEF DESCRIPTION OF THE DRAWINGS

Other features and advantages of the invention will emerge during the following description, provided with reference to the attached drawings illustrating, by way of example, various embodiments of the invention.

FIGS. 1 and 1A relate to devices in which the cam/sensing device cooperation generates traction on the oscillation element during the release operation, while, in FIGS. 2 and 2A, the cam/sensing device cooperation generates thrust on the oscillating element during the release operation.

FIGS. 11 to 14 are side views illustrating different types of boots produced according to the invention.

DESCRIPTION OF THE PREFERRED EMBODIMENT

Figures 1, 1A, 1B:
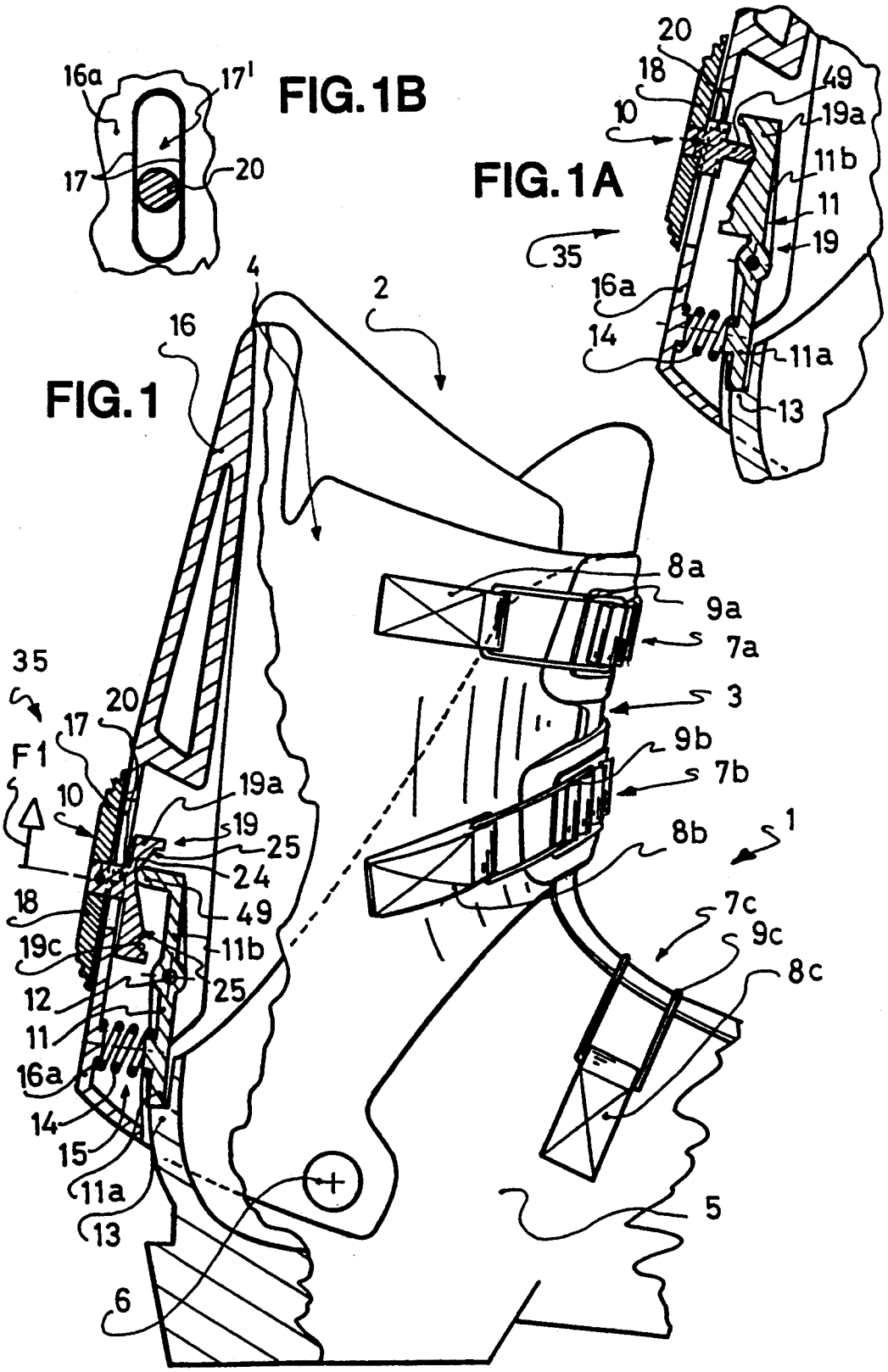
FIGS. 1, 1A, 2 and 2A are front elevation views of a portion of a ski boot shown partially in vertical cross-section, illustrating several embodiments of immobilization device according to the invention.

As one illustrative example, the ski boot 1 shown in FIG. 1 is of the "rear entry" type.

In accordance with the invention, boot 1 comprises an upper 2 which has a front part 3, or front cover, and a rear part 4, or rear cover, and a shell base 5 to which the rear part 4 of the upper 2 is attached by rivets 6, the front part 3 of the upper 2 being constituted by an extension of the shell base 5.

A three-point tightening system 7*a*, 7*b*, 7*c* which closes the upper over the skier's lower leg comprises, in conventional fashion, three separate tension levers 8*a*, 8*b*, 8*c* which fasten traction elements under tension, such as cable buckles 9*a*, 9*b*, 9*c* partially enclosing the front part of the upper 2, so as to be placed under tension by these tension levers 8*a*, 8*b*, 8*c*, which are, for example, levers 8*a* and 8*b* attached on the lateral wings arising from the rear cover 4, and lever 8*c*, on the front part of the boot.

According to the embodiment shown in FIG. 1, the boot 1 is provided with a device 35 for immobilization of the upper 2, which functions solely from front to back, and which includes a control mechanism 10 which acts on an oscillating lever 11 around a transverse pin 12 fastened on the rear part of the upper 2. The lever 11 swivels between a first position, in which a lower end part 11*a* of the lever 11 is stopped against a rear stop 13 on the shell base 5 in the heel area, for a selected forward-inclined position of the upper corresponding to an operative skiing position; and a second position in which the lower part 11*a* is released from the rear stop 13 on the shell base 5 in order to free the upper from any angled positioning stress, the control mechanism 10, or traveller, then acting on another part 11*b* of the oscillating lever opposite the end 11*a* in opposition to an elastic device 14 positioned in a housing 15 in the lower part 11*a* of the lever and acting in reaction against the wall 16*a* of the rear part 4 extending within the lower extension of a stiffening brace 16 of this rear cover 4 of the upper 2. The control device 10 on the oscillating lever 11 can slide on a slide rail 17 formed by at least one of the longitudinal edges of an oblong opening 17' in wall 16*a* belonging to the rear part 4 of the upper 2, and in which this control mechanism 10 is held while being free to travel in translational, independently of the oscillating lever. To be operated, the control mechanism 10 comprises respectively, arranged on either side of the wall 16*a*, an outer gripping element 18 whose translational motion can be manually controlled, and an inner part 19 which acts, by means of a cam 19*a*, on part 11*b* of the oscillating lever 11, which in fact constitutes the sensing device 49 belonging to the cam, parts 18 and 19 being connected by means of a bearing 20 corresponding to a groove in which the slide-rail 17 is placed.

According to the present embodiment, the cam 19*a* is constituted by the front end itself of the inner part 19 of the control mechanism 10, and it acts on the end 11*b* of the lever 11 opposite its lower end 11*a*. The transverse pin 12 is positioned between these ends 11*a*, 11*b*.

The frontal cam 19*a* of the control mechanism 10 incorporates, on either side of a low point 24, a groove extending to a high point 25, and these points determine, respectively, a front-to-back immobilization position or a back-to-front position of free angular motion of the latter, so as to provide for a certain translational movement in either direction applied to the gripping element 18 of the control mechanism 10.

Gripping element 18 of the operating device may have a shape other than the one shown, but in any case is made in one piece or rigidly connected to its grooved bearing 20, for example by means of a pin.

Position retention of the operating mechanism 10 on the wall 16*a* of the upper 2, this wall here forming an extension of the stiffening brace 16, is ensured by clamping the wall between the gripping element 18 and the bearing 20 which determines the slide groove cooperating with at least one of the longitudinal edges of the opening 17'.

The highest part of cam 19*a* comprises a recess or position-retention zone 19*c* corresponding to the cup-shaped high release point in which the corresponding end 11*b* of the lever 11 can be positioned so as to provide a stable release position. This position is obtained by effecting a simple translational movement in the direction F1 exerted on the gipping element 18.

The movement of translation of the cam 19*a* thus generated then drives the end 11*b* of the lever 11 in an angular motion around its pin 12 in accordance with values such that the difference in height between the low point 24 of the ramp and its high point 25 corresponds at least to a pivoting angle of the lever 11 allowing its lower part 11*a* to be released from the stop 13 in order to adopt a release position capable of leaving the rear part 4 of the upper 2 free to pivot angularly.

In accordance with the embodiment shown in FIG. 1A, the immobilization device 35 differs basically from the preceding one in that the cam 19*a* is set on the end 11*b* of the lever 11, while the sensing device 49 is positioned on the inner part 19 of the control mechanism 10.

Figure 2A:
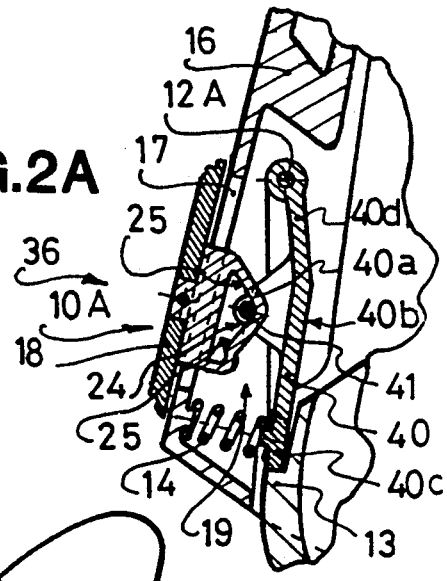
Figure 2:
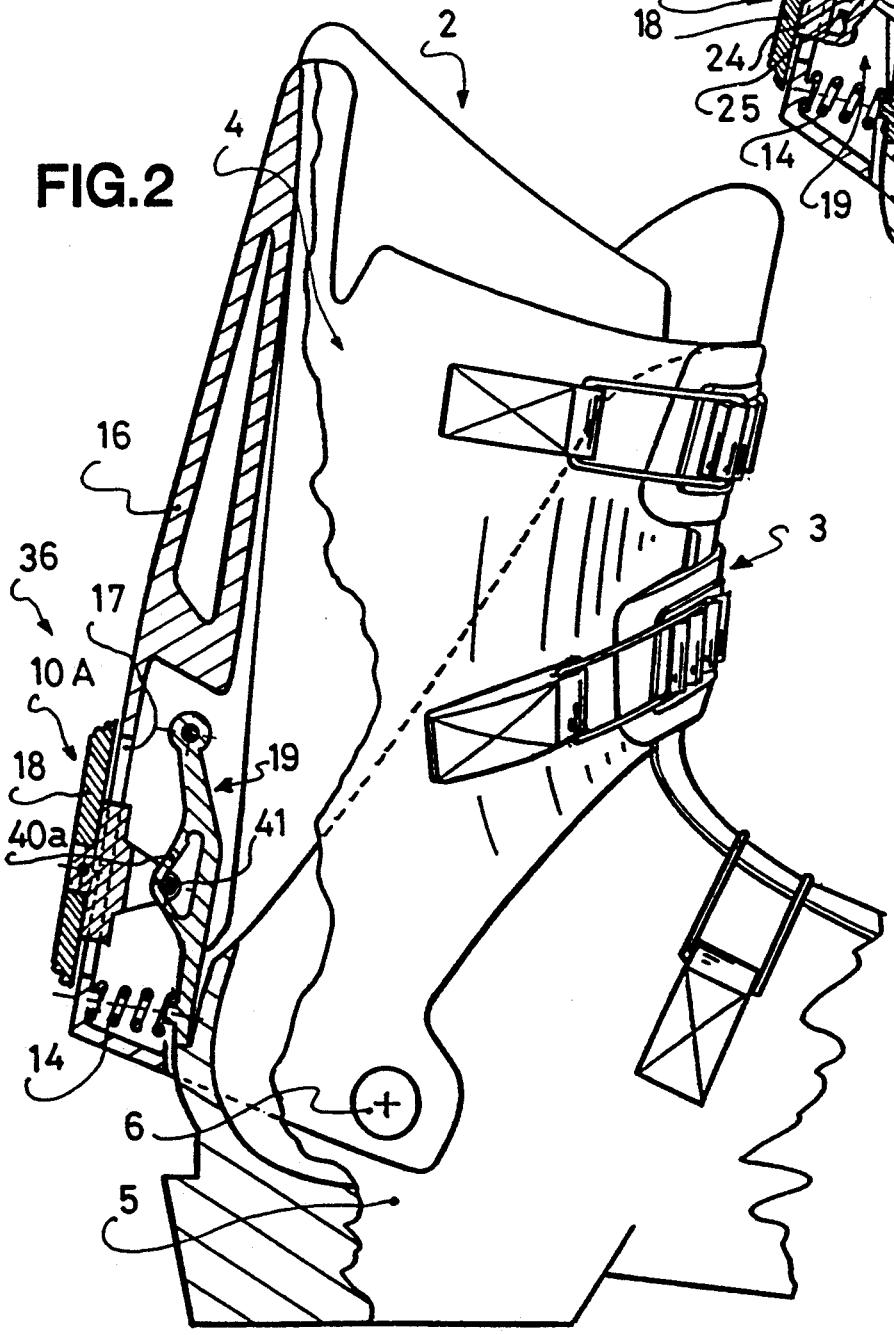

According to another embodiment illustrated in FIG. 2, the immobilization device differs basically from the previous one in that the cam 40*a* is arranged on an intermediate part 40*b* of the lever 40 located between the transverse pin 12A, set at one end 40*d* of the lever 40, and another opposite end 40*c* of the same lever 40 capable of coming into contact with the stop 13 in the locked position. This cam 40*a* is in permanent contact with a transverse control pin 41 forming the sensing device, which is attached to the control mechanism 10A, the ramp comprising a low point 24 and at least one high point 25, which correspond respectively, as in the previous embodiment, to an upper immobilization position 2 or to the reverse position of free angular motion of the upper, so as to allow a degree of movement of translation in one direction or the other and applied to the gripping element 18 of the control mechanism 10A, which acts on the cam 40*a* so as to cause this angled motion of the lever 40.

Of course, the cam 40*a* mentioned in the present embodiment could be fitted, as shown in FIG. 2A, not on a portion of the lever 40, but on an element belonging to the inner part 19 of the control mechanism 10A. In this case, the lever 40 is fitted with the sensing device 41 constituted by a transverse pin supported by tabs incorporated into the intermediate part 40*b* of the lever 40.

In accordance with the invention, the cam 19*a* and/or 40*a* may have different profiles as a function of the specified direction and/or directions of operation in translational motion, and of the amplitude of the desired sliding motion on the slide-rail 17, in order to travel from a locked to a released position, and/or vice-versa.

FIGS. 3 to 7 illustrate, by way of example, several embodiments of the profile of a cam 19*a* and/or 40*a* of the type described with respect to FIGS. 1 and 2.

Figure 3:
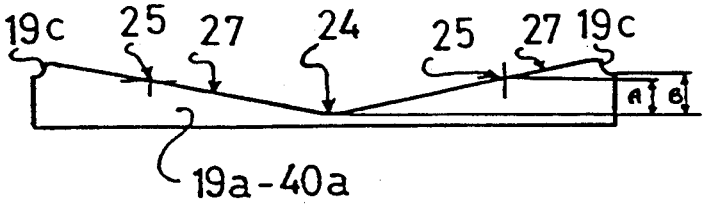
FIGS. 3 to 7 represent different profiles of the control cam of the immobilization device.
Figure 4:
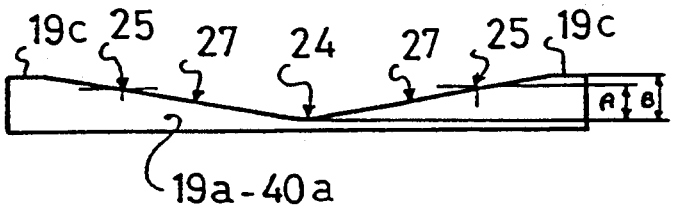

In FIGS. 3 and 4, the cam 19*a*, 40*a* has two symmetrical ramps 27, each of which extends in a gradually increasing fashion from the low point 24 to the position-retention zone 19c, while passing through the high release point 25. As previously explained, the difference in height between the low point 24 and the high point 25, referenced by the letter "A" in the drawings, is a function of engagement of the lower end section 11a of the lever 11 against the stop 13 on the shell base 5, as illustrated in FIGS. 1 and 2. According to the invention, this difference in height actually represents the value of the pivoting motion of the end 11b of the lever 11 required to release the upper 2 in relation to the shell base 5. This difference in height "A" is always less than, or equal to, the difference in height between the low point 24 and the position-retention zone 19c, referenced by the letter "B". In the embodiment of the cam 19a, 40a in FIG. 2, the position-retention zone 19c is advantageously given physical form by a notch in which the sensing device is designed to latch, thereby guaranteeing a stable release position of the sensing device and gearing in translational motion the cam 19a, 40a in the release position of the boot upper 2. As shown in FIG. 4, the position-retention zone 19c can obviously be constituted solely by a flat support surface. In these two embodiments of the cam 19a, 40a (FIGS. 3 and 4), the cam can be equally well operated, beginning at the low point 24, in both directions of translational movement, so as to release the boot upper. To obtain an unstable release position using this cam, the position-retention zone 19c is advantageously located beyond the release point. Accordingly, when the cam 19a, 40a is simply moved from its low point 24 to its high point 25 by means of the mechanism 10, then released before reaching the position-retention zone 19c, the boot upper is then momentarily released at the instant when the sensing device 41 or 49 reaches this high point 25. After releasing the control mechanism 10, the cam 19a, 40a can then return to the locked position under the effect of the thrust or traction generated by the sensing device on the corresponding ramp of the cam, depending on whether the device of is the type illustrated in FIG. 1 or FIG. 2. In addition, the cam can be returned to the locked position when acted upon by an elastic return element (not shown), which can be interposed between the mechanism 10 and a stationary point on the wall of the rear cover 4 on which it is held in place. This structure works in conjunction with a cam comprising a position-retention notch 19c in order to allow the stable release position to be reached and held when desired, despite the elastic return effect.

Figure 6:
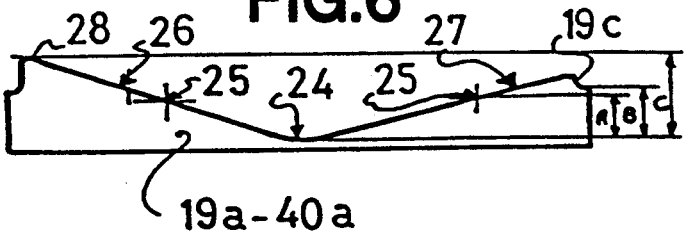
Figure 7:
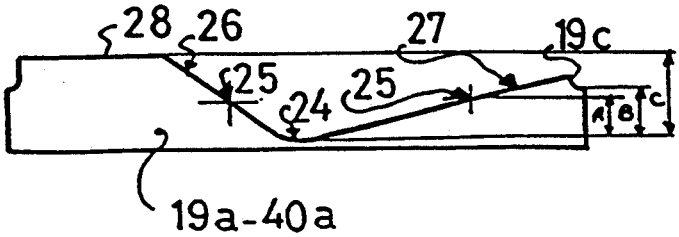

As illustrated in FIGS. 6 and 7, the cam 18a, 40a may also incorporate two asymmetrical ramps 26 and 27 extending on either side of the low point 24, one of them (27) being designed to permit only the stable release maneuver, and the other (26), only the unstable release maneuver. To this end, the ramp 26 extends clearly above the high release point 25 to a lever 28 which determines a difference in height "C" between the low point 24 and the high point 25 which is greater than the potential for swivelling motion of the oscillating lever 11 built into the rear part 4. Thus, when the cam 19a is manipulated in translational motion in the direction corresponding to unstable release, the sensing device 41 or 49 rises on the ramp 26 and passes the high point 25 toward level 28, while driving the lever 11 or 40 in a pivoting motion until its end part 11a or 40c, for example, is stopped against the wall 16 of the upper. When the control mechanism 10 is released, the cam 19a, 40a tends to return to the original locked position, as previously described. As shown in FIG. 7, the ramp 26 advantageously has a very pronounced incline, so that a relatively slight pressure of the sensing device causes, by means of bearing stress, the translational motion of the cam 19a until this sensing device becomes stabilized at the low looking point 24.

The release ramp 27 is configured in a manner similar to that described with reference to FIGS. 3 and 6, above.

Figure 5:
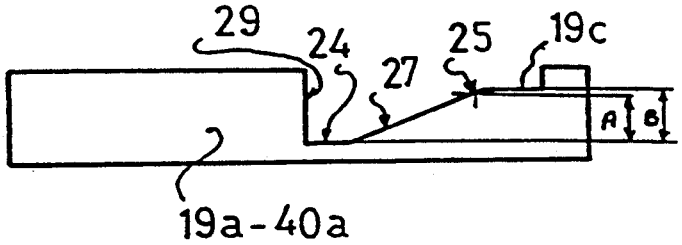

In the example in FIG. 5, the cam 19a, 40a is configured so as to be maneuverable only in a single direction of translational motion. It is fitted, for this purpose, with a stop surface 29 extending substantially vertically on one side of the low point 24 and opposite a single release ramp 27.

In all embodiments of a cam having asymmetrical ramps (FIGS. 6 and 7) or of a cam incorporating a single ramp (FIG. 5), the stable release ramp 27 may extend equally well in any direction of translational motion of the cam, and may have a more or less substantial length. This last feature is also applicable to the ramp 26.

The immobilization devices 35 and 36 just described with reference to FIGS. 1, 1A, 2, and 2A block the rear part 4 of the boot upper 2 only in the direction of a front-to-back pivoting movement around rivets 6 connecting with the shell base 5. This stop action is obtained by virtue of the fact that the oscillating levers 11 and 40 comprise lower end parts 11a and 40c which simply rest on this rear section. While remaining within the scope of the invention, the it is also possible to use immobilization devices similar to the devices 35 and 26, but in which the oscillating levers 11 and 40 are fitted with parts which, by cooperating with a stop on the shell base, immobilize the rear part 4 of the boot upper 2, also in the back-to-front direction.

Figure 8:
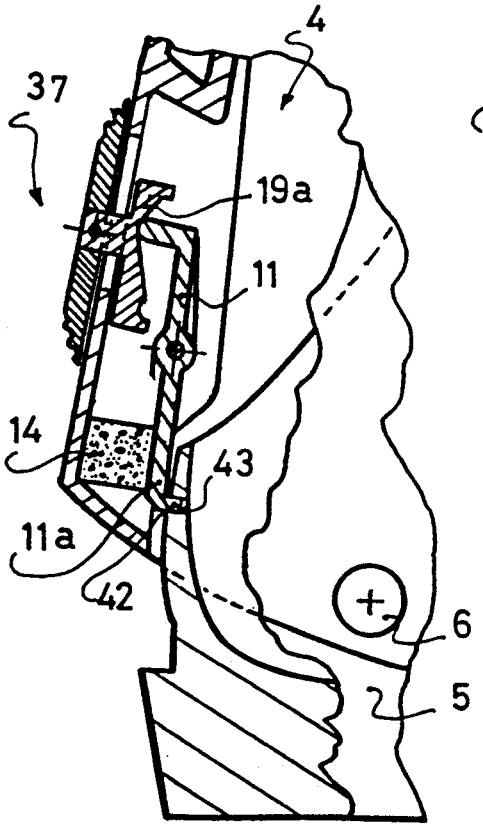
FIGS. 8, 9 and 10 illustrate different variants of the stop means associated with the immobilization device according to the invention, in vertical cross-section.

FIG. 8 illustrates, as an example, such an immobilization device 37, which utilizes the elements composing the immobilization device 35 in FIG. 1, with the exception of the lower end piece 11a of the oscillating lever 11. This end piece 11a takes on the shape of a projection 42, forming a catch piece designed to cooperate with a corresponding stop or notch 43 in the shell base 5 when the immobilization device 37 is placed in the upper-locking position and when the rear cover 4 is moved into the skiing position. In fact, as long as the rear cover 4 remains pivoted rearward, maneuvering the immobilization device 37 in order to lock it produces only the free pivoting motion of the oscillating lever 11, whose lower end piece 42, in this position of the rear cover 4, is supported against the outer wall of the shell base, the elastic device 14 then being compressed. In this embodiment, the elastic device 14 is constituted by an elastically compressible material instead of a helical spring, as shown diagrammatically in FIGS. 1, 1A, 2, and 2A.

Figure 9:
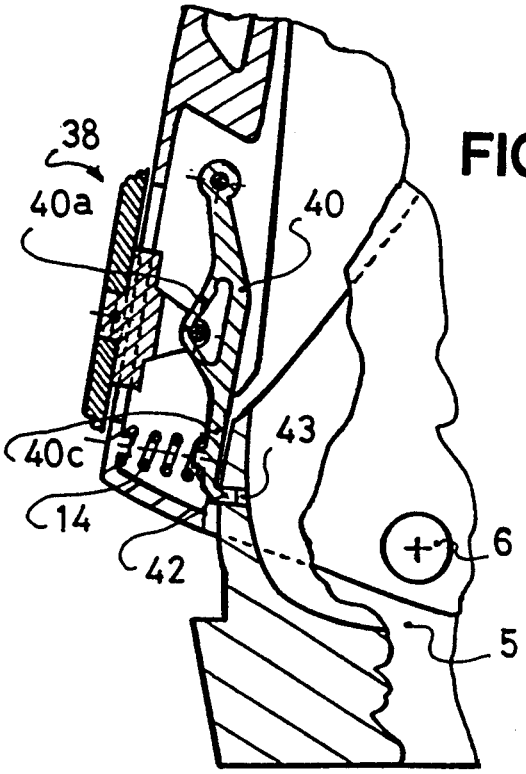

In FIG. 9, the immobilization device 38 is also of the front-to-back blocking type. This device incorporates the components of the immobilization device 36 in FIG. 2, with the exception of the lower end piece 40c of the oscillating lever 40, which is designed as a catch piece, in the same manner as on the oscillating lever 11 associated with device 37 in FIG. 8.

Figure 10:
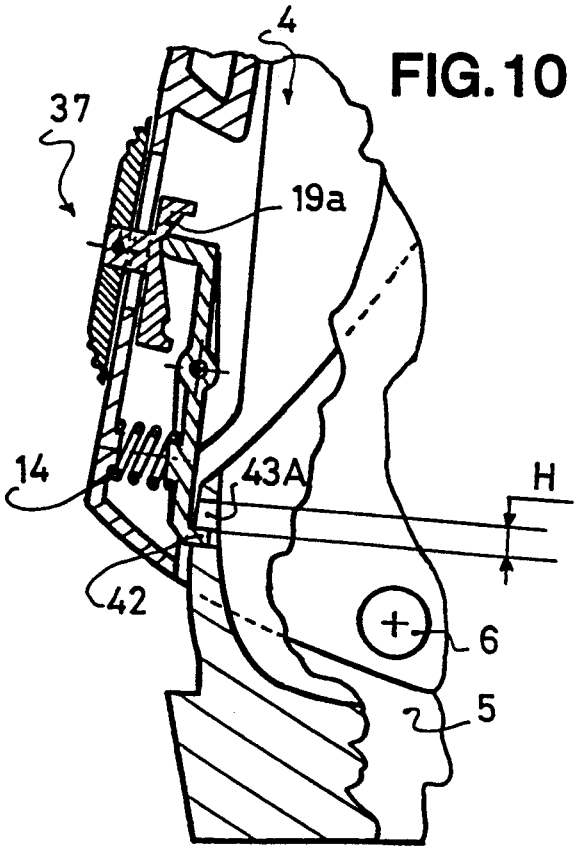

According to another embodiment, the immobilization devices 37 and/or 38 according to the invention may also cooperate with a stop or notch 43A on the shell base which extends vertically over a specific length at least greater than the thickness of the catch piece 42, as shown in the example in FIG. 10. In this example, immobilization device 37 is illustrated in operative position, the catch piece being inserted in the slot 43A. Since the rear part or cover 4 is centered on the attachment rivets 6, it can pivot on these rivets by a specific angular value which is a function of the length "H" of the slot 43A extending above the catch piece 42.

Still within the scope of the invention, the boots may have structures different from the preferred ones described with reference to FIGS. 1 and 2, and they may benefit in the same way from an immobilization device 35, 36, 37 or 38 such as that described above.

Figure 11:
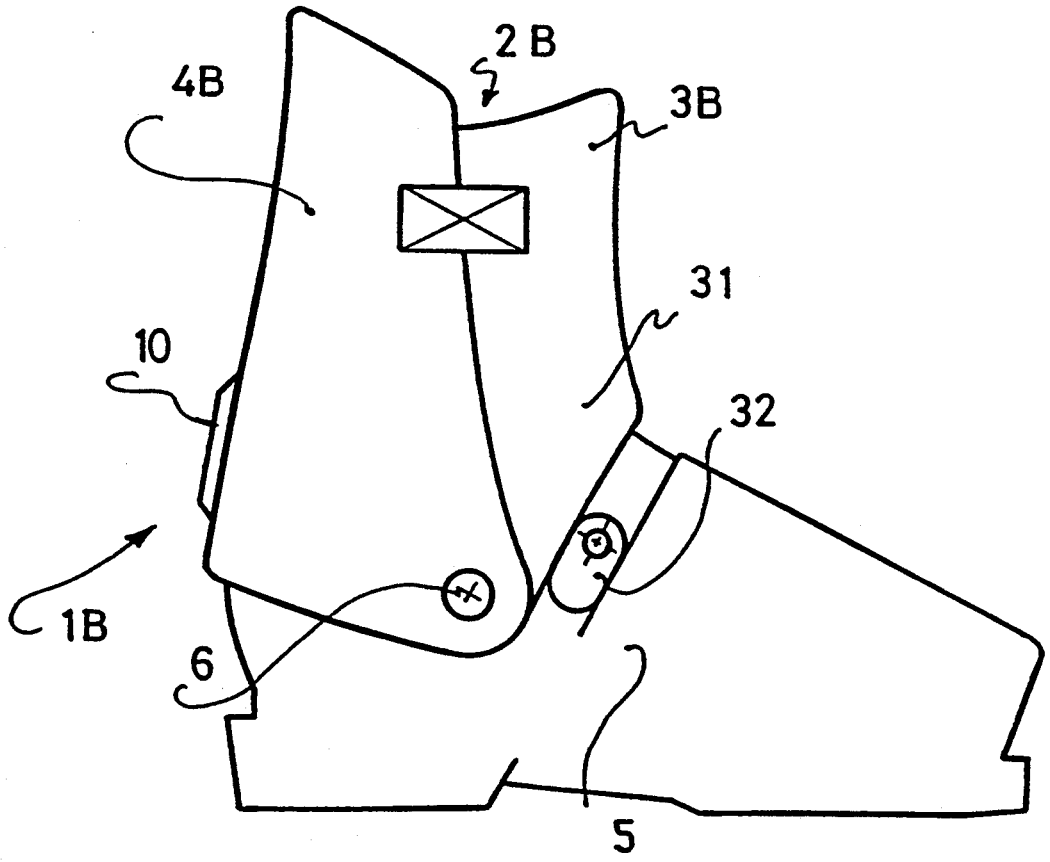

These boots may in fact include:

in FIG. 11, a "rear entry"-type boot 11. In the embodiment shown, the front-to-back pivoting action of a front cover 31 is controlled by a flection-control traveller 32, while the immobilization device blocks the upper in the front-to-back direction.

Figure 12:
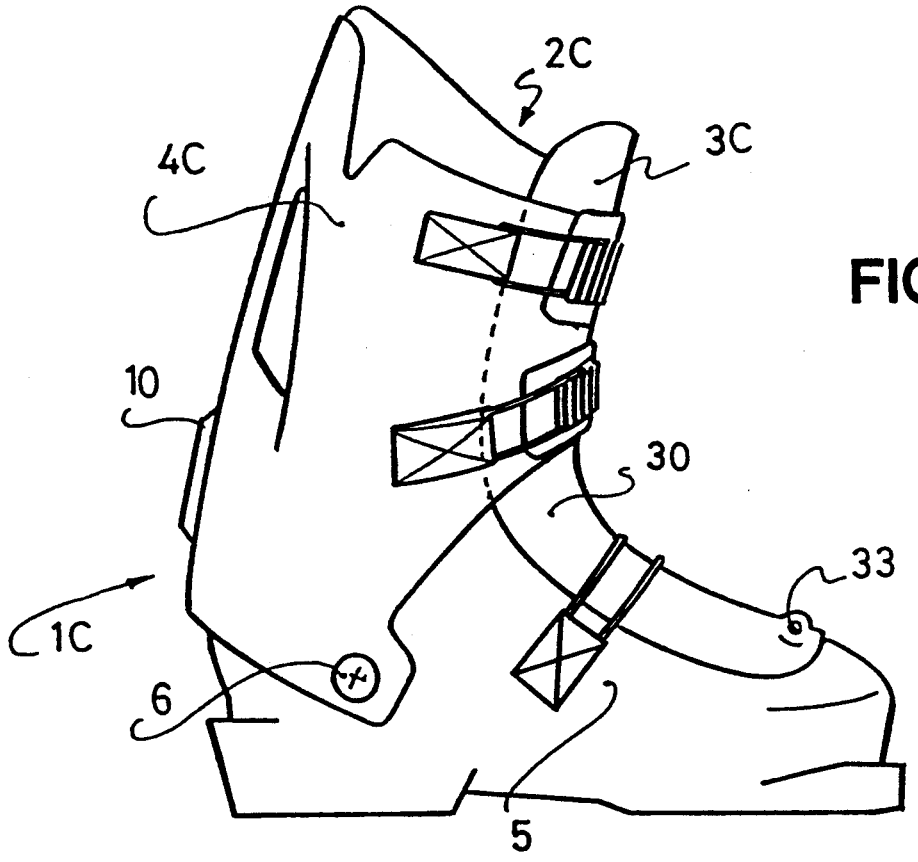
Figure 13:
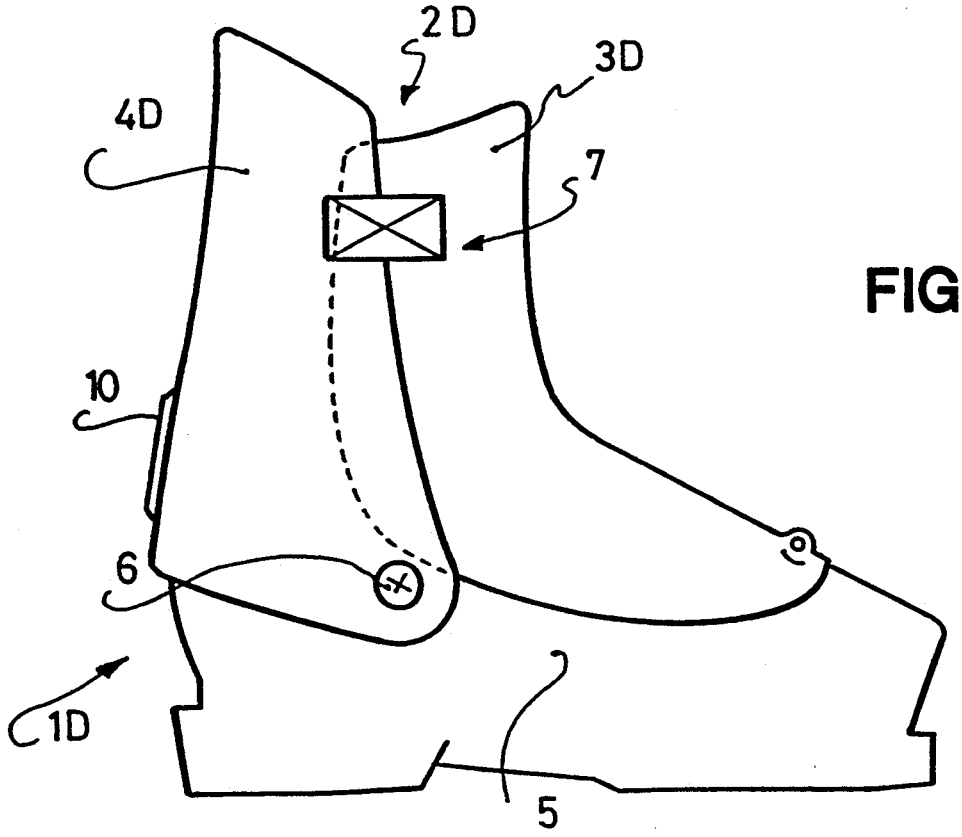

In the absence of the traveller 32, this would obviously also be a "mixed entry" boot whose front and rear parts, 3B and 4B respectively, could be drawn apart simultaneously or individually;

in FIG. 12, a "mixed entry" or "top entry" boot 1C in which the rear cover 4C can swing rearward, while the front cover 3C, which replaces the overlapping wings 30 in boot 1 (FIG. 1), forms a one-piece cover jointed in the area of the tip of the boot 1C by means of a jointed coupling device 33 and whose swinging action makes it possible to put on or remove the boot;

in FIG. 13 also, a "mixed entry" or top entry" boot 1D like boot 1C (FIG. 12). In this case, however, the means for closing the front cover 3D in association with the rear cover 4D function using tightening means 7 which ensure just the connection between these covers 3D and 4D, without appreciable overlapping of the wings on the rear cover over the front cover, as described with reference to the boots in FIGS. 1 and 2.

What is claimed is:

1. Alpine ski boot comprising a shell base (5) surmounted by an upper (2, 2B, 2C, 2D) provided with a system for closure on a base of a leg of a skier, said shell base being composed of a front part (3, 3B, 3C, 3D) and a rear part (4, 4B, 4C, 4D) made of at least one piece, the rear part of said upper (2, 2B, 2C, 2D) pivoting partially in the back-to-front and/or front to back direction, and comprising a device (35, 36, 37, 38) for immobilizing the upper in relation to said shell base (5) and which is functional for at least one of the directions of the pivoting motion of said rear part (4, 4B, 4C, 4D) of said upper (2, 2B, 2C, 2D) by means of a stop zone (13, 43, 43A) on said shell base (5), wherein said immobilization device (35, 36, 37, 38) is manipulated independently of said closure system by means of a rectilinear-motion control mechanism (10) comprising an external gripping portion (18) and an internal portion (19) connected to said external gripping portion by a bearing (20), said control mechanism (10) being slidable on a slide-rail (17) constituted by at least one longitudinal edge of an oblong opening (17') in a wall (16*a*) of said rear part (4, 4B, 4C, 4D) of said upper (2, 2B, 2C, 2D) and on which said control mechanism (10) is held while remaining free to travel in translational motion, by means of said bearing (20) and said external gripping portion (18) which jointly define a sliding groove cooperating with at least one longitudinal edge of said oblong opening (19'), said inner part (19) acting, by means of a cam (19*a*, 40*a*) cooperating with a sensing device (41, 49) on an oscillating lever (11, 40) which, pivoting about an axis (12, 12A) and subjected to the force of a return spring (14), is thus secured while pivoting in relation to said stop zone (13, 43, 43A) of said shell base (5).

2. Ski boot according to claim 1, wherein said cam (19*a*, 40*a*) extends parallel to the axis of translational motion of said control mechanism, and wherein it incorporates on its profile two ramps (27) having a progressively-increasing slope from a low point (24) to a high point (25), at least one of said ramps being extended by a position-retention zone (19*c*), a difference in height between said low point (24) and said high (25) point being determined as a function of the engagement of one end piece (11*a*, 40*c*, 42) of said oscillating lever (11, 40) on said stop zone (13, 43, 43A) on said shell base (5), and said difference in height being at least sufficient to cause, by means of said sensing device (41, 49), the pivoting motion of said lever (11, 40) corresponding at least to the pivoting motion of the engagement of said end piece (11*a*, 40*c*, 42) on said stop zone (13, 43, 43A).

3. Ski boot according to claim 2, wherein said cam (19*a*, 40*a*) comprises, beginning on a first side of said low point (24), a gradually increasing ramp (27), and, on a second side of said low point, a stop surface (29) against which said sensing device (41, 49) abuts.

4. Ski boot according to claim 2, wherein said cam (19*a*, 40*a*) incorporates two asymmetrical, gradually increasing ramps (26, 27) beginning at said low point (24).

5. Ski boot according to claim 4, wherein said ramp (26) of said cam 19*a*, 40*a*) extends beyond said high point (25) and is devoid of a position-retention zone.

6. Ski boot according to claim 1, wherein said cam (19*a*) is constituted by the end of said inner part (19) of said control mechanism (10), and secures said oscillating lever (11) while allowing it to pivot, by means of said end part (11*b*) of said oscillating lever, which is provided with said sensing device (19).

7. Ski boot according to claim 1, wherein said cam (40*a*) is centered on said intermediate part (40*b*) of said lever (40), which is positioned between its transverse pin (12A) fitted in one (40*c*) of its two, ends (40*b*, 40*c*) and its other, opposite end (40*c*) which is adapted to cooperate with said stop (13, 43, 43A) of said shell base (5).

8. Ski boot according to claim 1, wherein said immobilization devices (37, 38) incorporate an oscillating lever (11, 40) comprising an end piece (11*a*, 40*c*) fitted with a catch piece (42) designed, when said rear part (4) of said boot upper is drawn into an operative skiing position, to fit into a corresponding notch (43, 43A) so as to immobilize said rear part (4) in its pivoting motion in the front-to-back and back-to-front directions.

9. Ski boot according to claim 8, wherein said notch (43A) extends vertically and has a determinate length greater than the thickness of said catch piece, so as to give a value (H) corresponding to a potential pivoting action of said catch piece (42) in said slot (43A), which determines the freedom to pivot in the back-to-front direction of said rear part (4) of said upper prior to immobilization.

* * * * *